US006634687B1

(12) United States Patent
Hayes

(10) Patent No.: US 6,634,687 B1
(45) Date of Patent: Oct. 21, 2003

(54) IN-LINE SKATE MAINTENANCE RACK

(76) Inventor: Michael G. Hayes, 8182 Bushwick Dr., Huntington Beach, CA (US) 92646

( * ) Notice: Subject to any disclaimer, the term of this patent is extended or adjusted under 35 U.S.C. 154(b) by 0 days.

(21) Appl. No.: 09/641,784

(22) Filed: Aug. 18, 2000

Related U.S. Application Data

(60) Provisional application No. 60/149,546, filed on Aug. 18, 1999.

(51) Int. Cl.[7] ..... A45F 7/08

(52) U.S. Cl. ..... 294/143; 294/159; 211/37

(58) Field of Search ..... 294/137, 143, 294/145, 159; 211/85.7, 37; D6/552; 206/315.1

(56) References Cited

U.S. PATENT DOCUMENTS 4,269,337 A * 5/1981 Sobotka ..... 294/163
4,394,042 A * 7/1983 Smith ..... 294/163
5,269,580 A * 12/1993 Hsiao ..... 294/162
5,513,750 A * 5/1996 Rychel ..... 206/315.1
5,617,983 A * 4/1997 Lindauer et al. ..... 224/433
5,709,425 A * 1/1998 Cordova ..... 294/162
5,884,762 A * 3/1999 Roncato ..... 206/315.1
5,899,514 A * 5/1999 York et al. ..... 294/146
6,010,172 A * 1/2000 Comeau ..... 294/163

* cited by examiner

*Primary Examiner*—Dean J. Kramer
(74) *Attorney, Agent, or Firm*—Michael A. Kondzella

(57) ABSTRACT

An in-line skate maintenance rack has a pair of rests for a pair of in-line skates and inclined receptacles for holding wheels removed from the skates. The pair of rests and the inclined receptacles are so positioned that removed wheels are substantially parallel to wheels attached to the pair of skates.

6 Claims, 2 Drawing Sheets

IN-LINE SKATE MAINTENANCE RACK

This application claims the benefit of Provisional Application No. 60/149,546, filed Aug. 18, 1999.

BACKGROUND OF THE INVENTION

1. Field of the Invention

This invention relates to in-line skates. In one of its more particular aspects it relates to a rack for the maintenance of in-line skates. In another of its more particular aspects, it relates to a rack which is particularly adapted to be used in the rotation of in-line skate wheels.

2. Description of Related Art In-line skates require periodic maintenance. Lubrication, adjustment, and wheel rotation are needed for efficient skate use. For example, the wheels of in-line skates have been found to wear unevenly, so that continually wearing the skates without wheel rotation can result in unsatisfactory performance. Wheel wear is particularly pronounced in the front wheels and on the inside edges of all the wheels. Wheel rotation has been found to alleviate the problem of uneven wheel wear. Wheel rotation, however, is cumbersome, requiring some method of keeping track of the relative location of the wheels on the skates before and after rotation.

A need therefore exists for simplifying rotation of the wheels of in-line skates.

It is an object of the present invention to enable the fool-proof rotation of in-line skate wheels.

It is another object of this invention to keep track of each wheel relative to its position on the skate as the wheels are removed.

Another object of this invention is to facilitate the maintenance of in-line skates.

The foregoing objects are accomplished by providing a rack to hold the in-line skates and the wheels, as they are removed from the skates, in side-by-side relationship.

Other objects and advantages of the present invention will become apparent from the following detailed disclosure and description.

DESCRIPTION OF THE PREFERRED EMBODIMENTS

The rack of the present invention provides rests for the skates and inclined receptacles for a series of skate wheels generally parallel to the wheels on the skates resting upon the rack. The relationship between the rests for the skates and the wheel receptacles is such that when the skates are in position on the skate rests and a removed wheel or wheels are in one or more of the wheel receptacles, the skate wheels attached to the skate are above and parallel to the wheels in the wheel receptacles. This facilitates removal of the skate wheels and placement of the removed wheels in the receptacles, as well as adjustment, lubrication, rotation, and subsequent replacement of the wheels on the skates.

The rack of the present invention can also be provided with a handle for lifting the rack or a cover for enclosing it. A space on the rack for holding hardware removed from the skates, such as nuts, washers, and axles, can also be provided, as can a rack compartment for accommodating a variety of tools used in removing and replacing the wheels on the skates during maintenance thereof.

Figure 1:
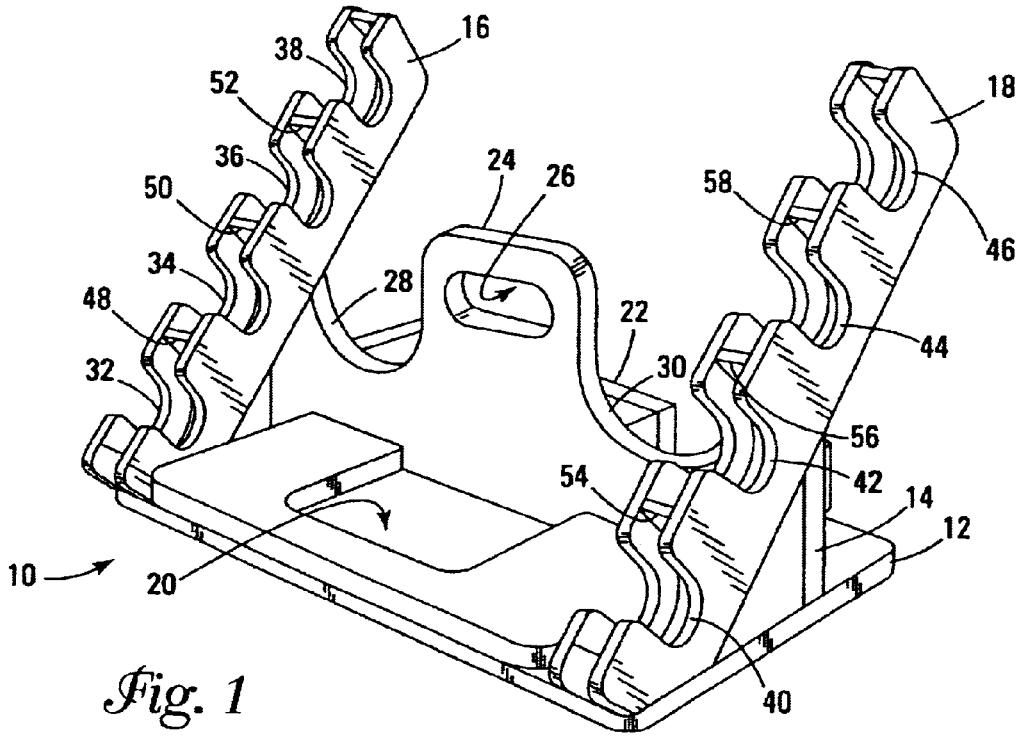
FIG. 1 is a perspective view of an in-line skate maintenance rack in accordance with the present invention.

Turning now to the drawings for a description of a specific embodiment of the invention, referring to FIG. 1, a rack 10 consists of a base 12, a vertical member 14, and two inclined wheel supports 16 and 18. Base 12 has a depression 20 on one side of vertical member 14 and a box 22 on the other side thereof. Member 14 is provided with a handle 24 having an aperture 26, and skate rests 28 and 30. Inclined wheel supports 16 and 18 are attached to vertical member 14. Wheel receptacles 32, 34, 36, and 38 are provided in wheel support 16, and receptacles 40, 42, 44, and 46 are provided in support 18. Support 16 is provided with dividers 48, 50, and 52, and support 18 is provided with dividers 54, 56, and 58. Although four receptacles are shown, any number of receptacles can be provided to accommodate the number of wheels on each in-line skate. For example, five receptacles are needed for five wheel in-line skates.

Figure 3:
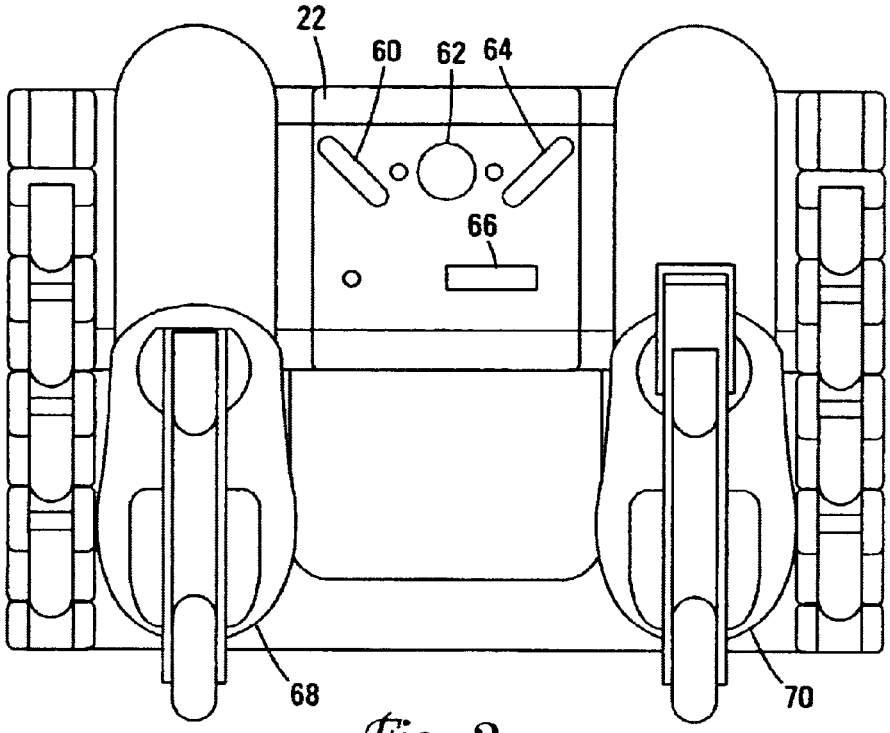
FIG. 3 is a plan view of the rack of the present invention showing skates and wheels in place as in FIG. 2.

As shown in FIG. 3, the bottom of box 22 is provided with tool holders 60, 62, 64, and 66.

Figure 2:
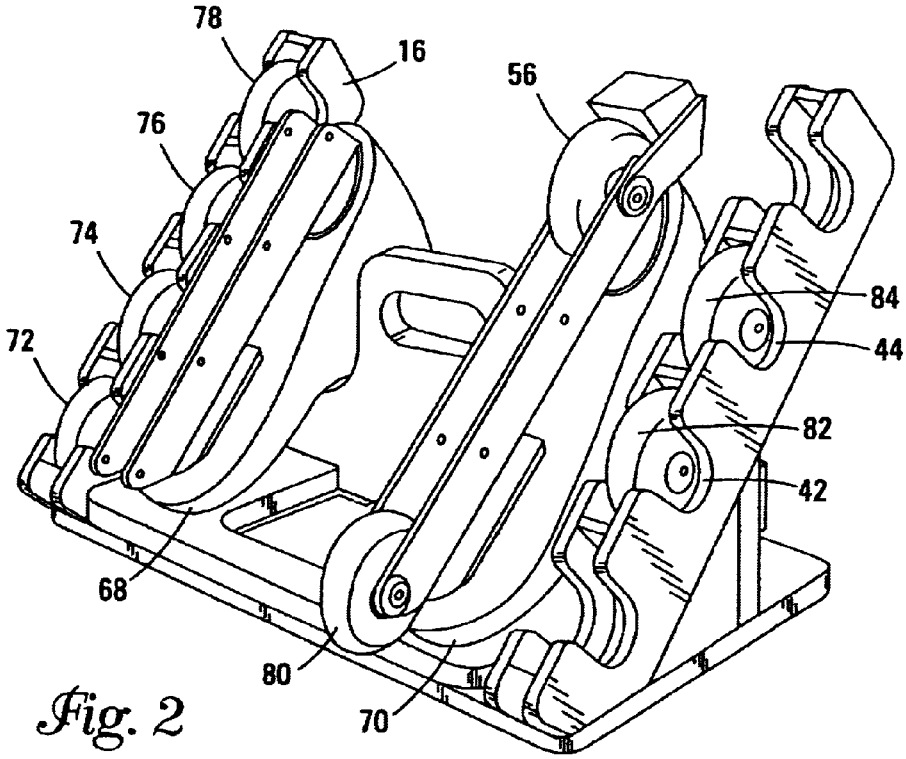
FIG. 2 is a perspective view of the rack of FIG. 1 showing skates and skate wheels positioned upon the rack.

Referring now to FIGS. 2 and 3, rack 10 is shown with in-line skates 68 and 70 resting upon skate rests 28 and 30 (FIG. 1), respectively. Skate wheels 72, 74, 76, and 78 are shown removed from skate 68 and placed within wheel receptacles 32, 34, 36,and 38 (FIG. 1), respectively.

Figure 4:
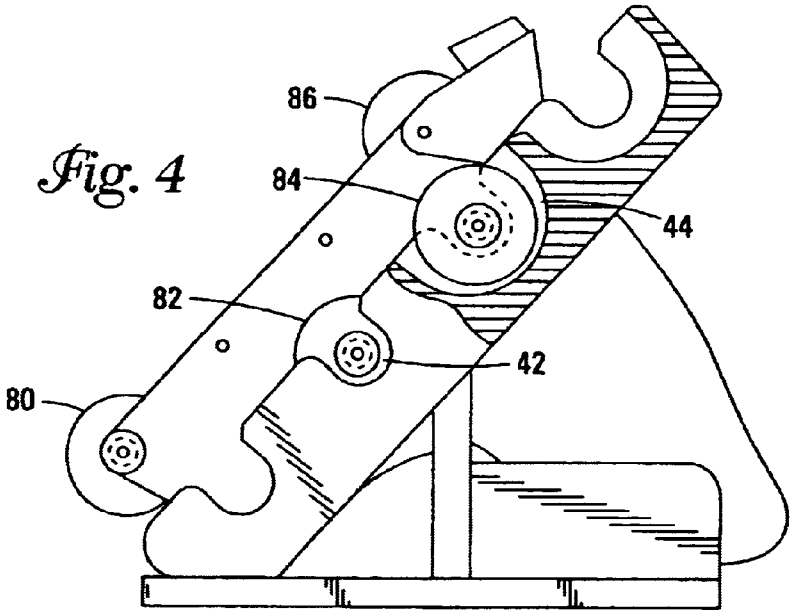
FIG. 4 is a right side elevation, partially broken away, showing the seating of the wheels within the rack.

Referring now to FIG. 4, it can be seen that wheels 80 and 86 attached to the skates are in a higher plane than wheels 82 and 84 in wheel receptacles 42 and 44, respectively. Having the skates and the removed wheels in the relative positions shown in FIG. 4 enables ready access to the wheels and hardware on the skates for ease of removal. Parallel placement of the attached and removed wheels facilitates wheel rotation, since, when a wheel is removed, it can be placed in the adjacent wheel receptacle and later remounted on the skate in the position to which it is intended to be rotated. The net result is fool-proof rotation of the skate wheels.

Using the rack of the present invention, a typical procedure might involve the following steps:

1. taking all eight wheels off;
2. measuring the diameters of the wheels with calipers;
3. putting the largest diameter wheel in the bottom receptacle;
4. putting the second largest diameter wheel in the top receptacle;
5. putting the third largest diameter wheel in the second from the bottom receptacle;
6. putting the fourth largest or smallest diameter wheel in the remaining receptacle; and
7. replacing the wheels on the skates in the order corresponding to the order in the rack.

It will be appreciated that the description and disclosure in the instant specification are set forth by way of illustration and not limitation, and that various modifications and changes may be made without departing from the spirit and scope of the present invention. For example, the inclined receptacles, although illustrated in a position outboard of the skate rests, can, in another preferred embodiment, be positioned inboard of the skate rests.

What is claimed is:

1. An in-line skate maintenance rack which comprises:

rests for a pair of in-line skates having a plurality of wheels attached thereto; and a pair of inclined receptacles for holding a plurality of skate wheels removed from said skates;

said receptacles being adapted to hold said plurality of removed skate wheels generally parallel to the wheels attached to said skates.

2. The in-line skate maintenance rack of claim 1, wherein the wheels attached to said skates are above and parallel to the wheels removed from said skates in said receptacles.

3. The in-line skate maintenance rack of claim 1, wherein said inclined receptacles are outboard of said rests.

4. The in-line skate maintenance rack of claim 1 which further comprises a handle.

5. The in-line skate maintenance rack of claim 1 which further comprises a space for holding hardware removed from said skates.

6. The in-line skate maintenance rack of claim 1 which further comprises holders for tools used in maintaining said skates.

* * * * *